US008448339B2

(12) United States Patent
Walker, Jr. et al.

(10) Patent No.: US 8,448,339 B2
(45) Date of Patent: May 28, 2013

(54) SHAVING CARTRIDGE WITH SUPRESSED BLADE GEOMETRY

(75) Inventors: Vincent Paul Walker, Jr., Bridgewater, MA (US); Stephen Charles Witkus, Northbridge, MA (US)

(73) Assignee: The Gillette Company, Boston, MA (US)

( * ) Notice: Subject to any disclaimer, the term of this patent is extended or adjusted under 35 U.S.C. 154(b) by 364 days.

(21) Appl. No.: 12/849,429

(22) Filed: Aug. 3, 2010

(65) Prior Publication Data

US 2012/0030948 A1 Feb. 9, 2012

(51) Int. Cl.
*B26B 21/40* (2006.01)

(52) U.S. Cl.
USPC ..... 30/50; 30/47; 30/77; 30/81; 30/82

(58) Field of Classification Search
USPC ..... 30/50, 77, 81, 82
See application file for complete search history.

(56) References Cited

U.S. PATENT DOCUMENTS

| | | | | | |
|---|---|---|---|---|---|
| 4,146,958 | A | * | 4/1979 | Chen et al. | 30/47 |
| 4,272,885 | A | * | 6/1981 | Ferraro | 30/47 |
| 4,409,735 | A | * | 10/1983 | Cartwright et al. | 30/47 |
| 4,697,342 | A | | 10/1987 | Ferraro | |
| 4,709,477 | A | * | 12/1987 | Ferraro | 30/50 |
| 4,741,103 | A | * | 5/1988 | Hultman | 30/34.2 |
| 4,854,043 | A | * | 8/1989 | Chen | 30/50 |
| 4,998,347 | A | * | 3/1991 | Schachter | 30/34.2 |
| 5,313,705 | A | * | 5/1994 | Rivers et al. | 30/50 |
| 5,388,332 | A | * | 2/1995 | Oldroyd | 30/50 |
| 5,475,923 | A | * | 12/1995 | Ferraro | 30/51 |
| 5,590,468 | A | * | 1/1997 | Prochaska | 30/41 |
| 6,161,288 | A | * | 12/2000 | Andrews | 30/50 |
| 6,473,970 | B1 | | 11/2002 | Prochaska | |
| 7,047,646 | B2 | | 5/2006 | Coffin | |
| 7,100,284 | B2 | * | 9/2006 | King | 30/49 |
| 7,210,229 | B2 | | 5/2007 | Coffin | |
| 7,607,230 | B2 | * | 10/2009 | Aviza et al. | 30/50 |
| 8,061,039 | B2 | * | 11/2011 | Kwiecien et al. | 30/41 |
| 8,146,255 | B2 | * | 4/2012 | Denkert et al. | 30/50 |
| 2002/0035786 | A1 | | 3/2002 | Gilder et al. | |
| 2003/0204955 | A1 | | 11/2003 | Gilder et al. | |

(Continued)

FOREIGN PATENT DOCUMENTS

| | | |
|---|---|---|
| WO | WO 95/25617 | 9/1995 |

OTHER PUBLICATIONS

PCT International Search Report with Written Opinion in corresponding Int'l appln. PCT/US2011/046411 dated Oct. 31, 2011.

*Primary Examiner* — Hwei C Payer
(74) *Attorney, Agent, or Firm* — John M. Lipchitz; Kevin C. Johnson; Steven W. Miller

(57) ABSTRACT

A shaving cartridge with a housing, a cap, and a guard. The guard has an upper surface. The cap has a top surface, a front edge, and an arcuate surface connecting the top surface and the front edge. A first blade between the cap and the guard has a cutting edge nearest the cap. A second blade between the cap and the guard has a cutting edge nearest the guard. The first and second blades define a blade plane tangent to the cutting edges. The blade plane is positioned below both (i) the surface of the guard and (ii) an intersection point of the front edge and the top surface of the cap.

17 Claims, 6 Drawing Sheets

U.S. PATENT DOCUMENTS

2003/0217469 A1 11/2003 Coffin
2004/0177513 A1 9/2004 Vreeland et al.
2005/0126007 A1 6/2005 Aviza
2008/0034593 A1 2/2008 Coffin
2010/0011588 A1 1/2010 Wang et al.
2010/0058595 A1 3/2010 Walker, Jr. et al.
2010/0083510 A1* 4/2010 Clarke ..... 30/346.5

* cited by examiner

SHAVING CARTRIDGE WITH SUPRESSED BLADE GEOMETRY

FIELD OF THE INVENTION

The present invention relates to shaving razors and more particularly to shaving cartridges with a guard, a cap, and plurality of blades defining a blade plane.

BACKGROUND OF THE INVENTION

In general, shaving razors of the wet shave type include a cartridge or blade unit with at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

Safety razors having cartridges with several blades have in recent years been sold in very large numbers and are generally acknowledged to give a better quality of shave, especially in terms of closeness, than single bladed razors. A blade unit having many blades can produce a closer shave than a similar blade unit with only one or two blades. However, closeness of shave obtained is only one parameter by which razor users judge the performance of a razor. Adding extra blades can have a serious detrimental influence on other blade unit characteristics, most notably the drag forces experienced when the blade unit is moved over the skin, with the consequence that the overall performance of the blade unit can be markedly inferior despite a closer shave being obtainable.

Razor cartridges usually include a guard which contacts the skin in front of the blade(s) and a cap for contacting the skin behind the blade(s) during shaving. The cap and the guard aid in establishing the so-called "shaving geometry", i.e., the parameters which determine the blade orientation and position relative to the skin during shaving, which in turn have a strong influence on the shaving performance and efficacy of the razor. The cap and the guard may aid in establishing the exposure of the blades. The blade exposure is defined to be the perpendicular distance or height of the blade edge measured with respect to a plane tangential to the skin contacting surfaces of the blade unit elements next in front of and next behind the edge. Therefore, for the three-bladed blade unit of the invention, the exposure of the first or primary blade is measured with reference to a plane tangential to the guard and the edge of the second blade, and the exposure of the third or tertiary blade is measured with reference to a plane tangential to the edge of the second blade and the cap.

The minimum acceptable exposure may be influenced by other blade unit dimensions, such as the distance from the skin engaging surface of the guard to the edge, i.e. "the span" of the primary blade. As referred to herein, "the span" means the distance from the blade edge to the skin contacting element immediately in front of that edge as measured along a tangent line extending between the said element and the blade edge. Another factor which can influence drag forces associated with the blades is the shaving angle, i.e. the angle between a plane bisecting the blade tip and the plane with respect to which the blade exposure is measured. However, the blade shaving angles are not critical and values within a broad range are acceptable, for example, 19-28°. It is not necessary for all three blades to have the same shaving angles, and the most effective values may depend on the span and exposure selected for each blade.

The guard may include a generally rigid guard bar that may be formed integrally with the housing or platform structure which provides a support for the blades. Guards may also include skin stretching elements made from various types of elastomeric materials that are intended to stretch the skin, but not align hair in front of the blade.

SUMMARY OF THE INVENTION

In one aspect, the invention features, in general, a shaving cartridge having a housing with a cap and a guard. The guard has an upper surface. The cap has a top surface, a front edge, and an arcuate surface connecting the top surface and the front edge. A first blade between the cap and the guard having a cutting edge is located nearest the cap. A second blade between the cap and the guard having a cutting edge is located nearest the guard. The first and second blades define a blade plane tangent to the cutting edges. The blade plane is positioned below both (i) the upper surface of the guard and (ii) an intersection point of the front edge and the top surface of the cap.

In another aspect, the invention features, in general, a shaving cartridge having a cap and a guard with an upper surface. The cap has a top surface, a front edge, and an arcuate surface connecting the front edge and the top surface of the cap. A first blade between the cap and the guard has a cutting edge located nearest the cap. A second blade between the cap and the guard has a cutting edge located nearest the guard. The first and second blades define a blade plane tangent to the cutting edges. The blade plane is positioned below both (i) the upper surface of the guard and (ii) an upper tangent of the arcuate surface and the top surface of the cap.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1:
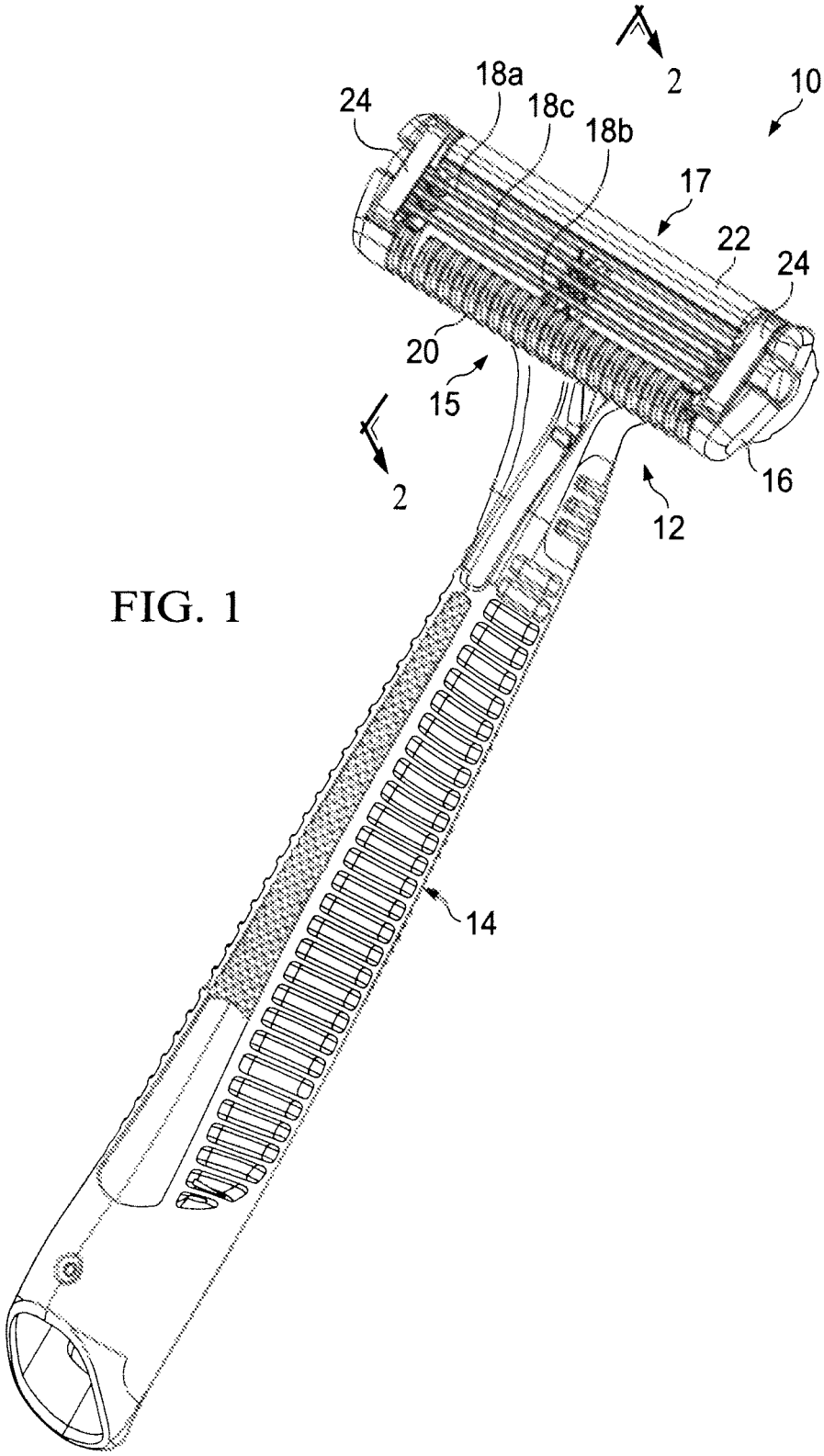
FIG. 1 is a perspective view of a shaving razor.

Referring to FIG. 1, one embodiment of the present disclosure is shown illustrating a shaving razor 10 having a shaving cartridge 12 mounted to a shaving razor handle 14. The shaving cartridge 12 may include a housing 16 dimensioned to receive at least one blade 18. The housing 16 may have a front portion 15 with guard 20 positioned in front of the blades 18. The housing 16 may also have a rear portion 17 with a cap 22 positioned behind the blades 18. The guard 20 and the cap 22 may aid in establishing a proper shaving geometry (e.g., blade exposure) for the shaving cartridge 12. The guard 20 and the cap 22 may be fixed relative to the housing 16 (e.g., are not adjustable or do not move during a shaving stroke). A first blade 18*a* may be nearest the cap 22 and a second blade 18*b* may be nearest the guard 20. One or more intermediate blades 18*c* may be positioned between the first blade 18*a* and the second blade 18*b*. Although three blades 18*a*, 18*b*, and 18*c* are shown, the cartridge 12 may have more or fewer blades 18 depending on the desired performance and cost of the shaving razor 10.

The shaving cartridge 12 may be pivotably (i.e., rotation of the cartridge 12 about an axis relative to the shaving razor handle 14) and/or detachably engaged to the shaving razor handle 14. It is understood that certain embodiments may include shaving cartridges 12 that pivot in relation to the handle 14, but are also secured to the razor handle 14 (i.e., not detachably engaged to the razor handle 14). In this embodiment, the entire shaving razor 10 may be discarded when the blade 18 or blades 18 have become dulled (i.e., disposable razor). Disposable razors may have either a pivoting or non pivoting type cartridge 12.

The blades 18 may be rigidly fixed to the housing such that the blades 18 do not move relative to the housing 16 during a shaving stroke. The blades 18 may be mounted to the housing 16 and secured in at least one direction by at least one clip 24. For example, two clips 24 may be bent over the blades 18 and around at least a portion of the housing 16 to secure the blades 18 within the housing 16. Although the clips 24 are shown as two separate components fixing the blades 18 within the housing 16, the clips 24 may also be a single piece design. In addition, the clips 24 may not necessarily be bent or formed around a portion of the housing 16 to fix the blades 18 relative to the housing 16. For example, the clips 24 may be snapped fit, press fit, glued, or ultrasonically welded to the housing 16 in order rigidly fix the clips 24 to the housing 16. The clips 24 may comprise a metal (e.g., aluminum or stainless steel) or a polymeric material (e.g., Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof.

The housing 16 and the handle 14 may be injection molded from a semi-rigid polymeric material. In certain embodiments, the housing 16 and/or the handle 14 may be molded from Noryl™ (a blend of polyphenylene oxide (PPO) and polystyrene developed by General Electric Plastics, now SABIC Innovative Plastics). The housing 16 and/or the handle 14 may be molded from other semi-rigid polymers having a Shore A hardness of about 60 to 140, including, but not limited to acrylonitrile butadiene styrene (ABS), acetal, polypropylene, high impact polystyrene, or any combinations thereof. The guard 20 may be molded from the same material as the housing 16 or a softer material. For example, the guard 20 may be molded from materials having a shore A hardness of about 20 to about 70, such as thermoplastic elastomers (TPEs) or rubbers.

The cap 22 may also be molded from the same material as the housing 16. In certain embodiments, the cap 22 may be molded from a shaving aid to provide lubrication to the surface of the skin during shaving. Alternatively the cap 22 may have a separate molded or extruded component that is assembled to the housing 16. For example, the housing 16 may have a shaving aid strip mounted to the cap 22. The cap 22 may be molded or extruded from the same material as the housing 16 or may be molded or extruded from a more lubricious material that has an effective amount of a water-leachable shaving aid composition to provide increase comfort during shaving. Shaving aid compositions may comprise a matrix of a water-insoluble polymer and, dispersed within the matrix, a skin lubricating water-soluble polymer. Alternatively, the shaving aid composition may comprise a sheath of water-insoluble polymer that surrounds a core which includes a skin-lubricating water-soluble polymer. Suitable water-insoluble polymers which can be used for the matrix (or sheath) include polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, most preferably a high impact polystyrene (i.e., Polystyrene-butadiene), such as Mobil 4324 (Mobil Corporation). Suitable skin lubricating water-soluble polymers include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides will preferably have molecular weights of about 100,000 to 6 million, most preferably about 300,000 to 5 million. The polyethylene oxide may comprises a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also advantageously contain up to about 10% by weight of a low molecular weight (i.e., MW<10,000) polyethylene glycol such as PEG-100. The shaving aid composition may also optionally include an inclusion complex of a skin-soothing agent with a cylcodextrin, low molecular weight water-soluble release enhancing agents Such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, cooling agents, etc.

Figure 2:
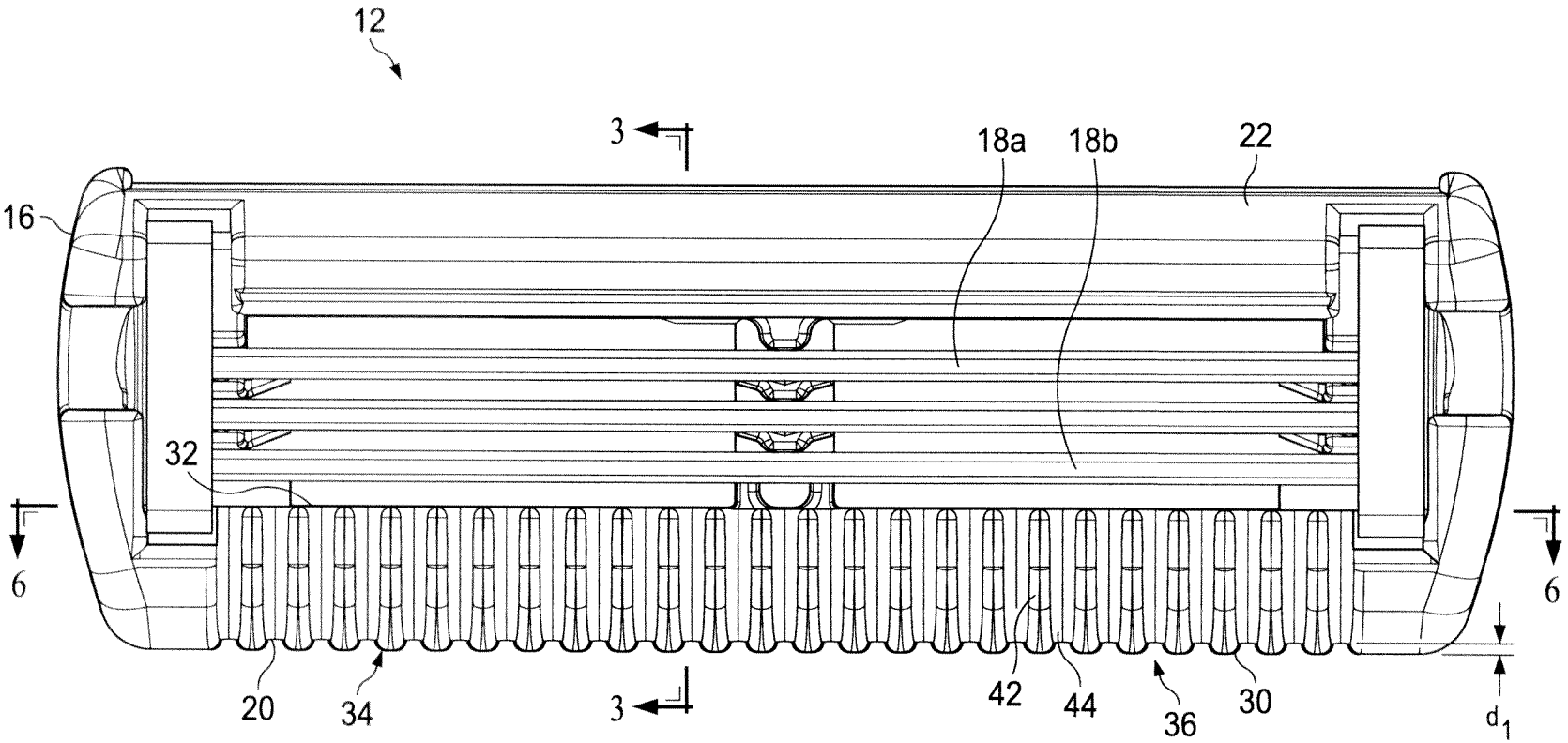
FIG. 2 is a top view of a cartridge of the shaving razor of FIG. 1.

Referring to FIG. 2, a top view of the cartridge 12 is shown. In certain embodiments, the cap 22, the guard 20, and the housing 16 may be a single piece construction that is injection molded. The guard 20 may have a front face 34 generally parallel to a rearward edge 32 of the guard 20. The rearward edge 32 may be immediately in front of the second blade 18*b*. The guard 20 may have a plurality of projections 30 that extend from the rearward edge 32 of the guard 20 toward the front face 34 of the guard 20. In particular, the projections 30 can be in the form of nubs or fin segments that are spaced apart or interconnected. The projections 30 may also have different patterns or may be oriented at different angles with respect to the blade 18. The projections 30 may include a substrate having a plurality of holes or other recessed patterns that define the projections 30. The projections 30 can also take the form of spaced fin segments that are arranged in rows oriented generally parallel to the blades 18 or spaced fin segments that are arranged both parallel to and perpendicular to the blade 18.

The projections 30 may define a plurality of open slots 36 that are transverse to the blades 18. The projections 30 and the open slots 36 of the guard 20 may manage the skin and hair during a shaving stroke to minimize nicks and cuts while improving cutting efficiency (e.g., less missed hairs during a shaving stroke). The open slots 36 may allow for the unobstructed passage of hair to the blade 18. The guard 20 may have an upper surface 42 (e.g., the top of projections 30) and a lower surface 44 between the projections 30 (i.e., the open slots 36). The lower surface 44 may be concave and extend between adjacent projections 30. The upper surface 42 may be convex such that the lower surface 44 and the upper surface 42 forms a continuous undulating skin contacting surface extending along the length of the guard 20 parallel to the blades 18. In certain embodiments, the lower surface 44 may contact the skin (e.g., support the skin); however skin types vary depending on the location and the individual. Accordingly, the lower surface 44 may not always be in continuous contact with the skin during a shaving stroke. The projections 30 may have a generally circular cross section (e.g., oval). The lower surface 44 and/or the upper surface 42 may have a radius of about 0.15 mm, 0.20 mm, or 0.25 mm to about 0.5 mm, 0.75 mm, or 1.0 mm. The slots 36 may have a slot depth "$d_1$" between the lower surface 44 and the upper surface 42 of about 0.50 mm, 0.75 mm, or 1.0 mm to about 1.25 mm, 1.5 mm, or 2.0 mm. The slot depth may be measured anywhere along the guard 20 (e.g., the rearward edge 32 or the front face 34). As will be explained in greater detail below, the slot depth between the lower surface 44 and the upper surface 42 measured at and/or toward the rearward edge 32 of the guard may be less than the slot depth between the lower surface 44 and the upper surface 42 measured at the front face 34 of the guard 20.

Figure 3:
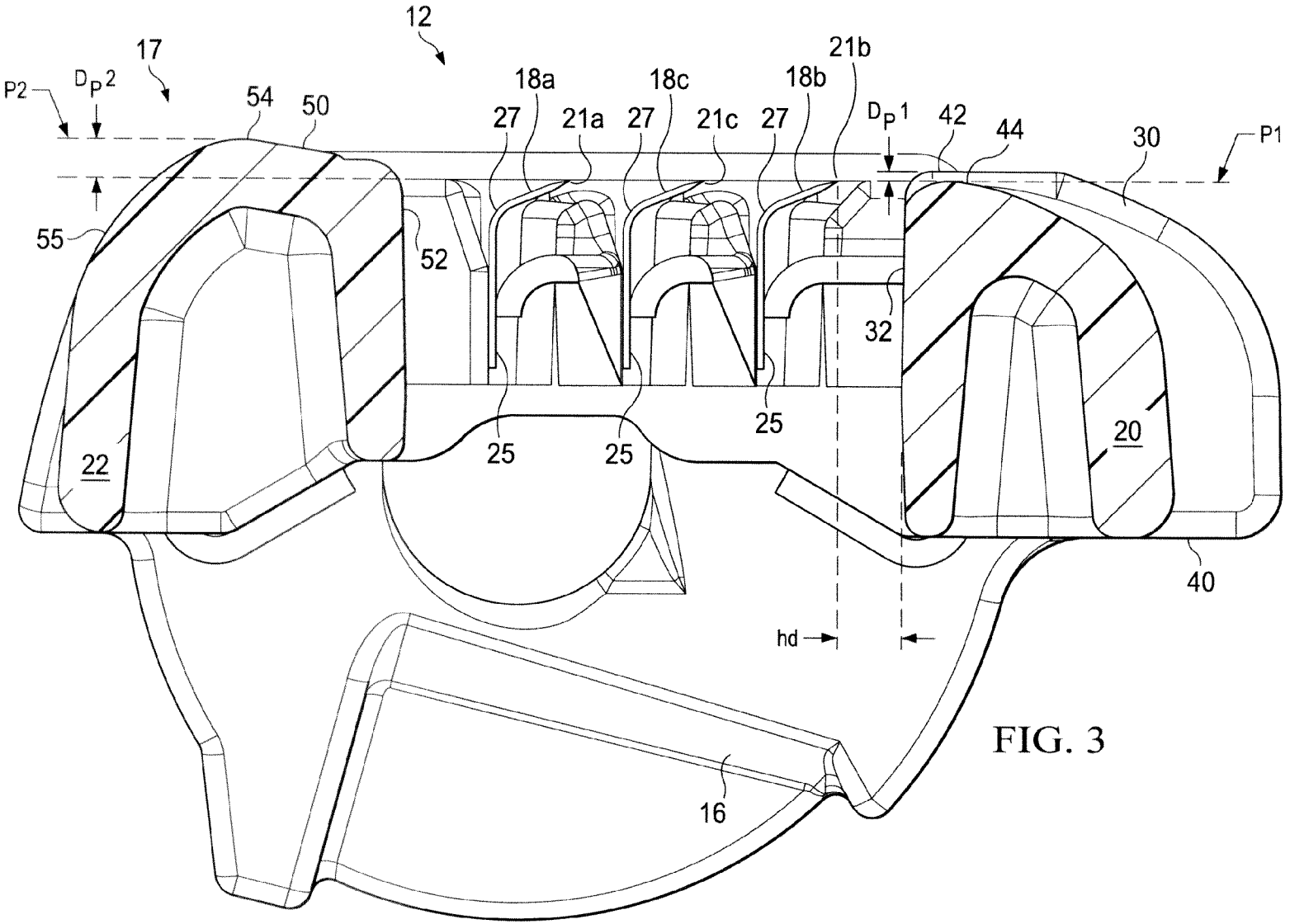
FIG. 3 is section view of the cartridge, taken generally along the line 3-3 of FIG. 2.

Referring to FIG. 3, a section view of the cartridge 12, taken generally along the line 3-3, of FIG. 2 is shown. The first blade 18*a* and the second blade 18*b* may each have a respective cutting edge 21*a* and 21*b*. In certain embodiments, the projections 30 may extend up to, but not beyond the rearward edge 32. For example, a horizontal distance "hd" from the second blade 18*b* (i.e., the cutting edge 21*b* closest to the guard 20) to the rearward edge 32 may be equal to a horizontal distance from the blade 18 to the projections 30. In other embodiments, the distance "hd" from the second blade 18*b* (i.e., the cutting edge 18*b* closest to the guard 20) to the rearward edge 32 may be less than the horizontal distance from the blade 18 to the projections 30. The projections 30 being spaced further away from the blade 18*b* than the rearward edge 32 (i.e., the projections 30 do not overhang the rearward edge 32) may reduce nicks and discomfort during shaving. The cutting edges 21*a* and 21*b* may define a blade plane P1 (i.e., tangent to the cutting edges 21*a* and 21*b*). In certain embodiments, each of the blades 18 may have a corresponding elongated support portion 25 and a corresponding bent portion 27 between the cutting edge 21 and the elongated support portion 25. A razor cartridge having a razor blade with a bent portion can have certain advantages, such as decreased manufacturing costs and improved rinsability. However, it is understood that certain embodiments may include blades that are directly mounted to a housing or blades mounted on bent supports. For example, the blades may be mounted on a bent metal support that is attached to a housing. This particular embodiment may include a planar blade attached (e.g., welded) to the bent metal support. The bent metal support may provide the relatively delicate blade with sufficient support to withstand forces applied to blade during the shaving process.

The blade plane P1 may be suppressed in relation to certain features of the cap 22 and/or guard 20. It is believed, without being held to theory that the blade geometry (e.g., exposure and position of the blade plane P1 relative to the cap 22 and the guard 20) for spring loaded blades (i.e., blades that move relative to the cap and guard during a shaving stroke) do not work well for fixed blades. For example, the vertical position of the blades relative to the cap and guard do not perform the same for fixed vs. spring loaded blades. A cartridge having spring loaded blades may produce a comfortable shave, but the same cartridge having fixed blades may be overly aggressive and uncomfortable even though the neutral position of the blades relative to the cap and the guard (i.e., no force acting on the blades) of the blades are the same for both cartridges.

The blade plane P1 may be suppressed in relation to certain features of the guard 20 to provide a close and comfortable shave for a fixed blade cartridge. In certain embodiments, the projections 30 of the guard 20 may extend from the rearward edge 32, around the front face 34, and to a bottom edge 40 of the housing 16 (e.g., guard 20) to improve skin contact and skin support as the cartridge 12 moves (e.g., pivots) around the contours of the face and body (e.g., knee, neck, and chin). The upper surface 42 of the guard 20 may be positioned a perpendicular distance "$D_P$1" above the blade plane P1 of about 0.05 mm, 0.07 mm, or 0.09 mm to about 0.1 mm, 0.125 mm, or 0.15 mm. In certain embodiments, the lower surface 44 may also be positioned a perpendicular distance at or above the blade plane P1. For example, the lower surface 44 may be positioned a perpendicular distance above the blade plane P1 of about 0 mm to about 0.05 mm. The blade plane P1 may also be suppressed in relation to certain features of the cap 22. The cap 22 may have a top surface 50 that extends (e.g., inclines) from a front edge 52 adjacent the first blade 18*a* to a rearward crest 54 at the rear portion 17 of the housing 16. The cap 22 may extend from the front edge 52 past the rearward crest 54, to a rear face 55 of the housing 16. A horizontal plane P2 (e.g., generally parallel to the blade plane P1) may be tangent to the rearward crest 54 and may be positioned a perpendicular distance "$D_P$2" above the blade plane P1 by about 0.25 mm, 0.30 mm, or 0.35 mm to about 0.4 mm, 0.5 mm, or 0.6 mm.

Figure 4:
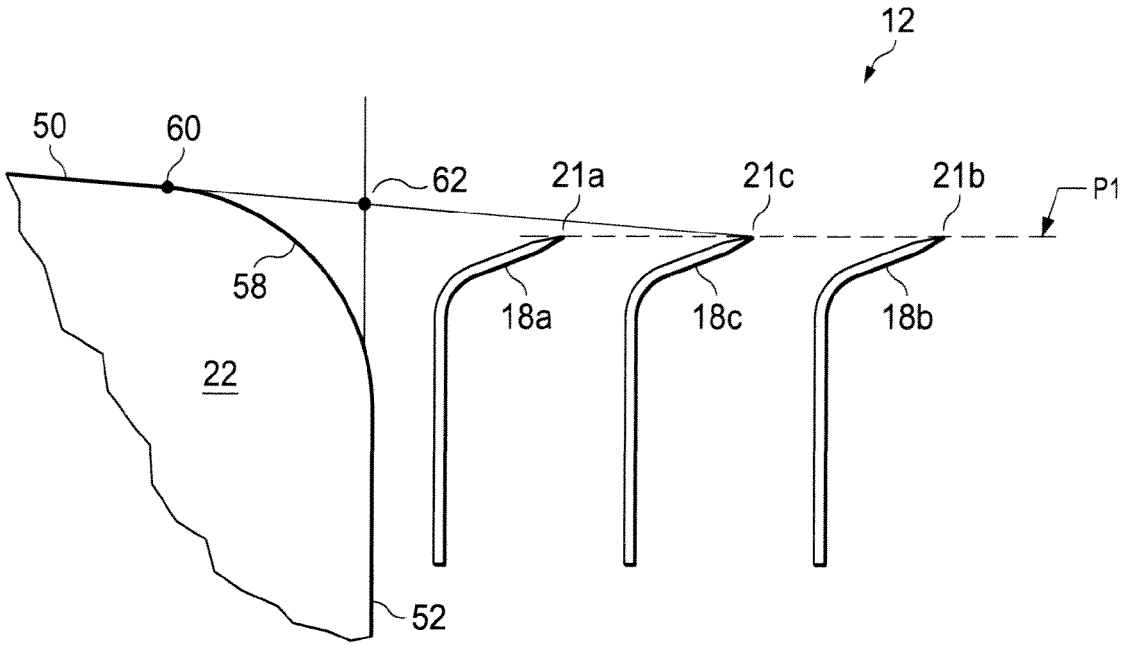
FIG. 4 is a partial schematic view of the cartridge of FIG. 2.

Referring to FIG. 4, an enlarged schematic view of the cartridge 12 illustrating the cap 22 and the blades 18 is shown in greater detail. An arcuate surface 58 may connect the front edge 52 and the top surface 50 of the cap 22. An upper tangent 60 of the arcuate surface 58 and the top surface 50 of the cap 22 may be positioned a perpendicular distance above the blade plane P1 by about 0.25 mm, 0.30 mm, or 0.35 mm to about 0.4 mm, 0.5 mm, or 0.6 mm. An intersection point 62 of the front edge 52 and the top surface 50 of the cap 22 may be positioned a perpendicular distance above the blade plane P1 by about 0.25 mm, 0.30 mm, or 0.35 mm to about 0.4 mm, 0.5 mm, or 0.6 mm. In certain embodiments, both the upper tangent 60 of the arcuate surface 58 and the top surface 50 of the cap 22 may be positioned a perpendicular distance above the intersection point 62 of the front edge 52 and the top surface 50 of the cap 22.

Figure 5A:
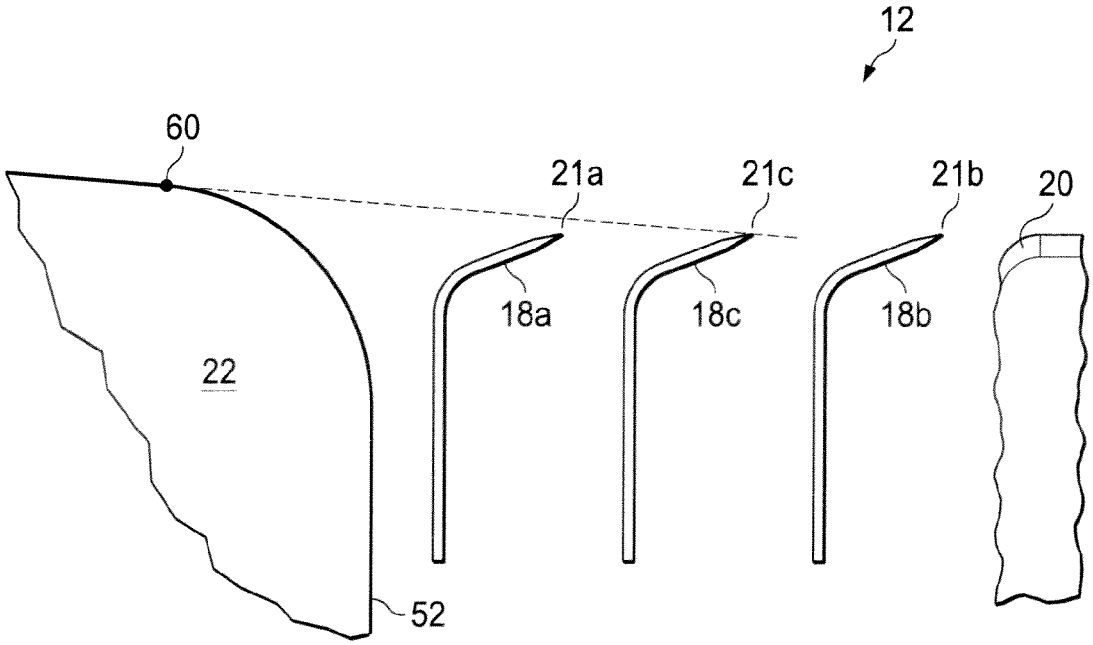
FIGS. 5A-5C are schematic views of the cartridge of FIG. 2.
Figure 5B:
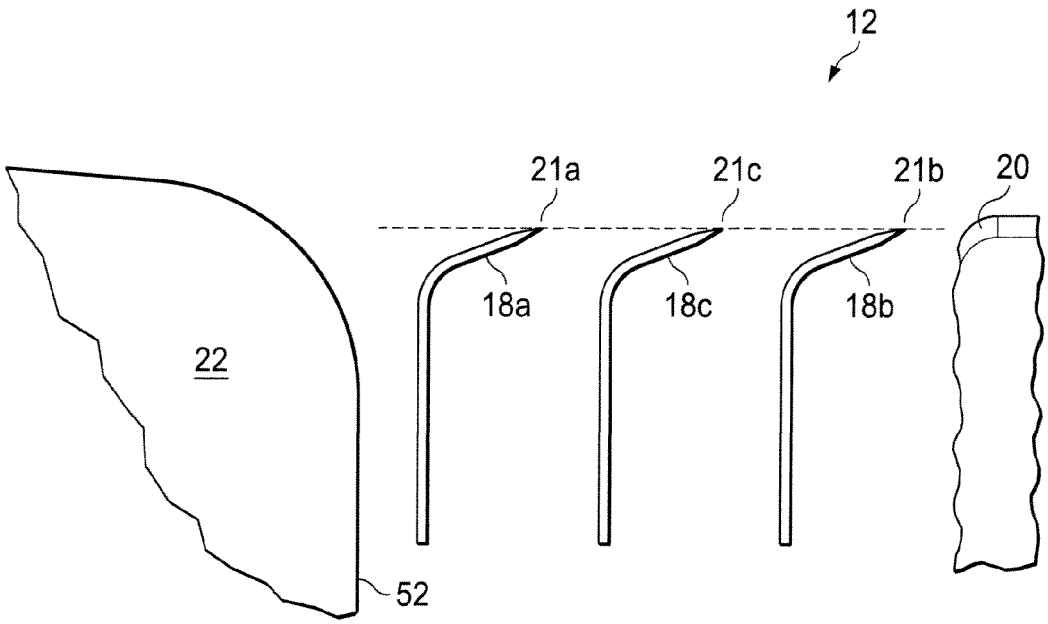
Figure 5C:
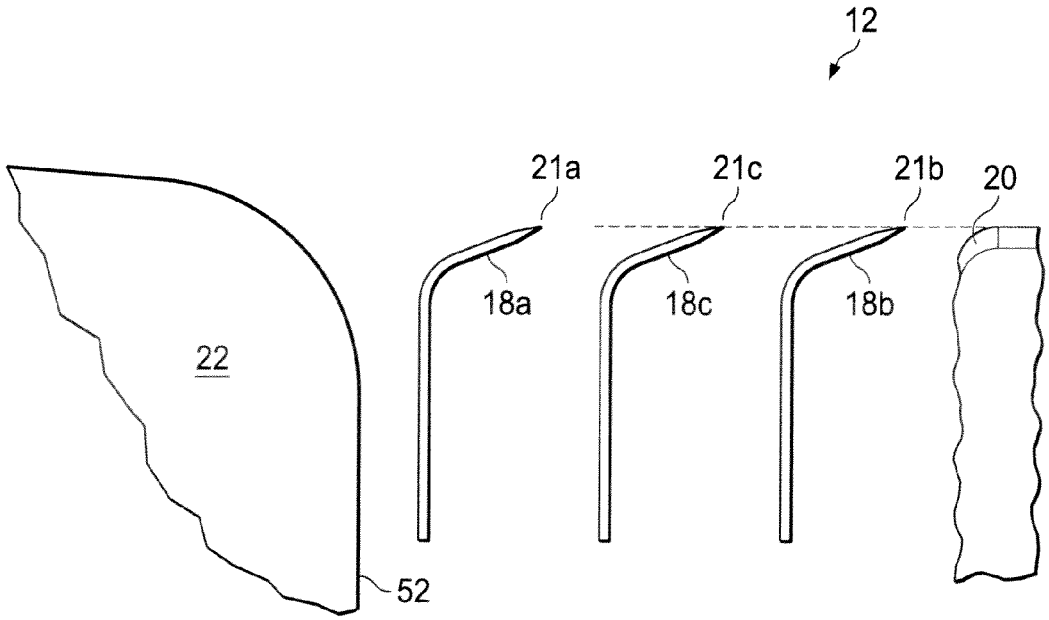

Referring to FIGS. 5A-5C, a schematic view of the cartridge 12 is shown. FIG. 5A illustrates the exposure of the first blade 18*a*. The exposure of the first blade 18*a* is defined as the position of the cutting edge 21*a* relative to a tangent line extending from the cap 22 (i.e., the upper tangent 60 of the arcuate surface 58 and the top surface 50 of the cap 22) to the cutting edge 21*c* of the blade 18*c* immediately in front of the first blade 18*a*. The exposure of the first blade 18*a*, which is nearest the cap, is negative (e.g., −0.4 mm). FIG. 5B illustrates the exposure of the third or middle blade 18*c*. The exposure of the middle blade 18*c* is defined as the position of the cutting edge 21*c* relative to a tangent line extending from the cutting edge 21*a* of the first blade 18*a* (immediately behind the middle blade 18*c*) to the cutting edge 21*b* of the blade 18*b* immediately in front of the middle blade 18*c*. The exposure of the middle blade 18*c*, which is nearest the cap, may be zero (i.e., lies on the same plane as the tangent line). FIG. 5C illustrates the exposure of the second blade 18*b*. The exposure of the second blade 18*b* is defined as the position of the cutting edge 21*b* relative to a tangent line extending from the cutting edge 21*c* of the blade 18*c* immediately behind of the second blade 18*b* to the guard 20 (i.e., skin contacting structure immediately in front of the second blade 18*b*). More specifically, the exposure of the second blade 18*b* may be measured from the tangent line extending from the cutting edge 21*c* of the blade 18*c* immediately behind the second blade 18*b* to the top skin contacting surface 42 of the guard or to the lower surface 44 of the guard. The exposure of the second blade 18*b*, which is nearest the guard 20, may be negative (e.g., −0.06 mm).

Figure 6:
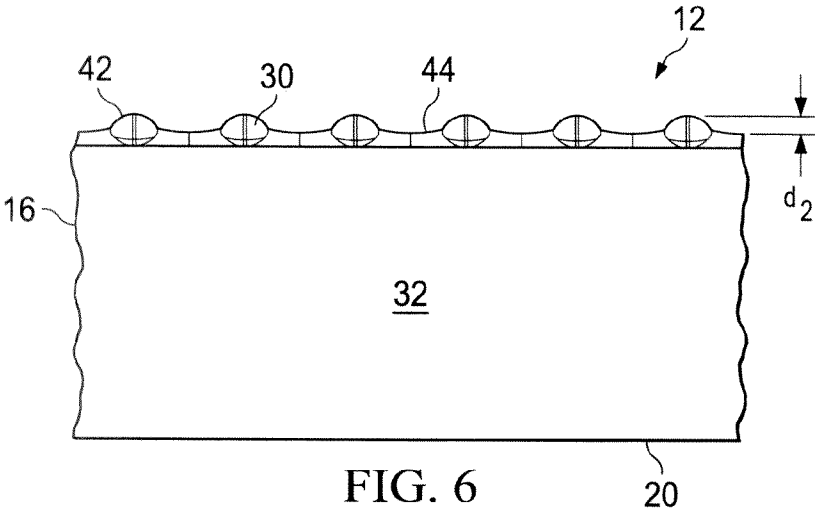
FIG. 6 is section view of the cartridge, taken generally along the line 6-6 of FIG. 2.

Referring to FIG. 6, a section view of the cartridge 12 is shown, taken generally along the line 6-6 of FIG. 2 (the guard 20 being immediately in front of the line 6-6). In certain embodiments (e.g., as shown in FIG. 6), the projections 30 may extend up to, but not beyond the rearward edge 32 of the guard 20. The slots 36 may have a slot depth "$d_2$" between the lower surface 44 and the upper surface 42 measured toward the rearward edge 32 (e.g., about 0 mm, 0.05 mm, or 0.1 mm to about 0.125 mm, 0.15 mm, or 0.175 mm from the rearward edge) of the housing 16 that is less than or equal to the slot depth "$d_1$" (see FIG. 2) between the lower surface 44 and the upper surface 42 measured at the front face 34 of the housing 16. For example, in certain embodiments, the slot depth $d_2$ may be about 0.10 mm, 0.15 mm, or 0.20 mm to about 0.3 mm, 0.4 mm, or 0.5 mm. The term "toward" may be defined as being at the rearward edge 32 or up to 1 mm from the rearward edge 32. The lower surface 44 and the upper surface 42 may support the skin during shaving to prevent skin bulge, which may result in nicks and discomfort. It is believed (without being held to theory), that if $d_2$ is too deep (i.e., greater value for $d_2$), the skin may not be sufficiently supported by the lower surface 44 which may result in discomfort. The skin may sag between the projections 30 during a shaving stroke, which may result in increased skin bulge and discomfort. If $d_2$ is too shallow (i.e., smaller value for $d_2$), the projections 30 may not adequately align the hair prior to the blades cutting the hair, which may result in an increased number of missed hairs and poor closeness. In certain embodiments, the slot depth between the projections 30 may taper from a greater value at the front face 34 (i.e., $d_1$) to a lesser value at the rearward edge 32 (i.e., $d_2$) to improve skin management and hair alignment.

Figure 7:
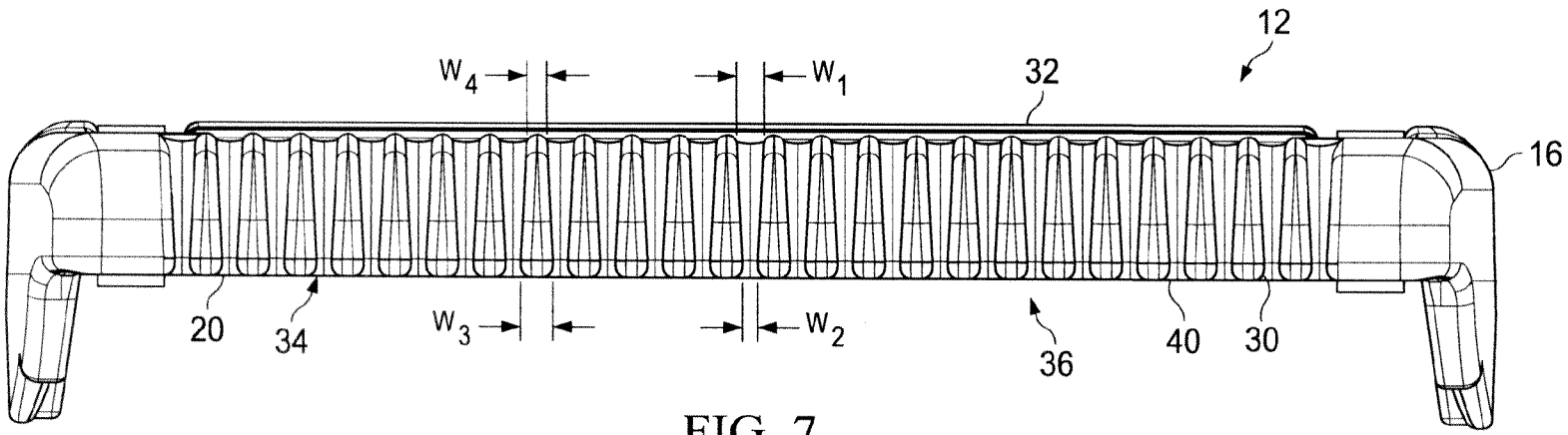
FIG. 7 is a front view of the cartridge of FIG. 2.

Referring to FIG. 7, a front view of the cartridge 12 is shown. The projections 30 may be spaced apart such that the open slots 36 taper outward as the slots extend from the bottom edge 40 of the housing 16, up the front face and toward the rearward edge 32 of the housing 16. For example, a width "$w_1$" of the slots 36 may be greater toward the rearward edge 32 of the housing 16 relative to a width "$w_2$" of the slots 36 toward the bottom edge 40 of the housing 16. In certain embodiments, $w_1$ may be about 0.5 mm, 0.6 mm, or 0.7 mm to about 0.8 mm, 0.9 mm, or 1.0 mm and $w_2$ may be about 0.25 mm, 0.30 mm, or 0.35 mm to about 0.40 mm, 0.45 mm, or 0.49 mm. The projections 30 may have a width "$w_3$" that is greater toward the bottom edge 40 of the guard 20 than a width "$w_4$" of the projections 30 toward the rearward edge 32 of the guard 20. In certain embodiments, $w_3$ may be about 0.8 mm, 0.9 mm, or 1.0 mm to about 1.2 mm, 1.4 mm, or 1.6 mm and $w_4$ may be about 0.3 mm, 0.40 mm, or 0.5 mm to about 0.59 mm, 0.69 mm, or 0.79 mm. The taper of the open slots 36 may facilitate the molding of the projections 30 from the rearward edge 32 to around the front face 34 of the housing 16.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving cartridge comprising:

a guard having an upper surface;

a cap having a top surface, a front edge, and an arcuate surface connecting the top surface and the front edge;

a first blade between the cap and the guard having a cutting edge nearest the cap and;

a second blade between the cap and the guard having a cutting edge nearest the guard, the first and second blades defining a blade plane tangent to the cutting edges and positioned below both (i) the upper surface of the guard and (ii) an intersection point of the front edge of the cap and the top surface of the cap; wherein the first and second blades are fixed relative to the guard and the cap, wherein the guard has a plurality of projections that define a plurality of open slots having a lower surface positioned at or above the blade plane.

2. The shaving cartridge of claim 1 wherein the blade plane is positioned below an upper tangent between the arcuate surface and the top surface of the cap.

3. The shaving cartridge of claim 1 wherein the upper surface of the guard is positioned a perpendicular distance of about 0.05 mm to about 0.15 mm above the blade plane.

4. The shaving cartridge of claim 1 wherein the intersection point is positioned a perpendicular distance of about 0.3 mm to 0.5 mm above the blade plane.

5. The shaving cartridge of claim 1 further comprising at least one additional blade having a cutting edge positioned between the cutting edges of the first and second blades.

6. The shaving cartridge of claim 5 wherein the at least one additional blade is fixed relative to the cap and the guard.

7. The shaving cartridge of claim 5 wherein the cutting edge of the at least one additional blade is positioned at or below the blade plane.

8. The shaving cartridge of claim 6 wherein the first and second blades have a negative exposure and the at least one additional blade has a neutral exposure.

9. The shaving cartridge of claim 6 wherein the cap has a rearward crest 0.3 mm to 0.5 mm above the blade plane.

10. The shaving cartridge of claim 6 wherein the cap, the guard, form a single piece housing.

11. A shaving cartridge comprising:

a housing having a guard with an upper surface, and a cap with a top surface, a front edge, and an arcuate surface connecting the front edge and the top surface of the cap;

a first blade between the cap and the guard, a second blade between the cap and the guard, the first blade having a cutting edge nearest the cap and the second blade having a cutting edge nearest the guard, the first and second blades defining a blade plane tangent to the cutting edges, wherein the blade plane is positioned below both (a) the upper surface of the guard and (b) an upper tangent of the arcuate surface and the top surface of the cap, wherein the guard has a plurality of projections that define a plurality of open slots having a lower surface positioned at or above the blade plane.

12. The shaving cartridge of claim 11 wherein the first and second blades are fixed relative to the guard and the cap.

13. The shaving cartridge of claim 11 wherein the blade plane is positioned (a) a perpendicular distance of about 0.05 mm to about 0.15 mm below the upper surface of the guard and (b) a perpendicular distance of about 0.3 mm to about 0.5 mm below the upper tangent of the arcuate surface and the top surface of the cap.

14. The shaving cartridge of claim 11 wherein the top surface of the cap inclines from the front edge to a rearward crest.

15. The shaving cartridge of claim 14 wherein the rearward crest of the cap is positioned at least 0.3 mm above the blade plane.

16. The shaving cartridge of claim 15 wherein the upper surface of the guard is positioned at least 0.1 mm above the blade plane.

17. The cartridge of claim 15 wherein the cap has a rear surface that declines toward the rear portion of the housing.

* * * * *